US006520271B1

(12) United States Patent
Martini

(10) Patent No.: US 6,520,271 B1
(45) Date of Patent: Feb. 18, 2003

(54) FLUID POWERED ROTARY DRILLING ASSEMBLY

(76) Inventor: Leo A. Martini, P.O. Box 795, Edgewood, TX (US) 75117

( * ) Notice: Subject to any disclaimer, the term of this patent is extended or adjusted under 35 U.S.C. 154(b) by 135 days.

(21) Appl. No.: 09/694,997

(22) Filed: Oct. 24, 2000

(51) Int. Cl.[7] ..... E21B 4/02

(52) U.S. Cl. ..... 175/21; 175/107; 175/318; 175/324

(58) Field of Search ..... 175/107, 106, 175/170, 234, 243, 318, 320, 324, 21

(56) References Cited

U.S. PATENT DOCUMENTS 4,114,702 A * 9/1978 Maurer et al. ..... 175/107
4,187,061 A * 2/1980 Jurgens ..... 418/48
RE30,246 E * 4/1980 Richter, Jr. et al ..... 175/65
4,880,065 A * 11/1989 McDonald et al. ..... 175/71

* cited by examiner

*Primary Examiner*—David Bagnell
*Assistant Examiner*—Zakiya Walker
(74) *Attorney, Agent, or Firm*—John F. Bryan

(57) ABSTRACT

A drilling fluid powered rotary drilling motor is mounted on the downhole end of a non-rotating fluid conducting drill string has a drill bit on its distal end and a plurality of fluid engaging, rotating elements coupled to at least one speed reducing planetary gear stage that converts the kinetic and pressure energies of the drilling fluid to mechanical power for rotating the drill bit. The drilling motor includes a lubricator, a drilling fluid filter, a pressure relief valve, a bypass valve and a check valve and is mounted with an output isolation coupling and a bearing package sized to withstand drilling load conditions.

24 Claims, 6 Drawing Sheets

FLUID POWERED ROTARY DRILLING ASSEMBLY

TECHNICAL FIELD

The present invention relates to a fluid powered rotary drilling assembly used for downhole drilling application with a non-rotating drill string and more specifically to such assemblies employing relatively high speed, fluid powered motors coupled with one or more stages of an epicyclic gear train. Applications for the present invention include coiled tubing oil well servicing and workover apparatus as used to drill cement out of well tubing, to deepen oil wells by drilling through well tubing and to remove mineral deposits from oil well production tubing. Other applications include open hole vertical and horizontal oil, gas, and water well drilling, highway and construction boreholes, environmental test hole drilling and blast hole quarry drilling.

BACKGROUND

There is only one type of fluid powered rotary drilling assembly for downhole drilling in general use today. This unit employs a single or multiple lobed orbiting rotor or moyno type motor which is available in several very similar variations. The orbital rotor of moyno motors in general use at this time have a rubber stator and an eccentric, orbiting rotor which have universal joints to provide axial output. These universal joints result in an undesirable increase in the length of the motor and can set up lateral vibrations and shock waves that tend to increase motor and bit wear, enlarge the borehole and may even cause caving and collapse of the borehole wall. The rubber stator is used to provide close internal clearances, while having tolerance for debris in the circulated fluid. However, these motors are not suitable for operation with compressible or semi-compressible fluids such as nitrogen foam emulsions because of high internal friction and consequent overheating and degradation of the rubber stator during such operation.

Direct drive axial turbine motors have been used in relatively small numbers. These devices operated at a relatively high rotational speed and required a larger volume of drilling fluid than would normally be used for drilling. The rotational speed was higher than desirable for drilling and the motor torque output was inadequate for drilling most formations. As a result, this type of motor is no longer used anywhere in the industry.

A first object of the present invention is therefore, to provide a fluid powered downhole drilling assembly which is capable of operation with non-compressible, semi-compressible or compressible fluids and which is capable of operation with emulsified fluids. A second object of the present invention is to provide such an assembly with a motor having a high tolerance for debris in the operating fluid. A third object of the present invention is to provide such an assembly with a motor having a high tolerance for operating at elevated down hole temperatures. A fourth object of this invention is to provide a rotationally balanced motor to minimize operational vibration of the drilling assembly. Yet other objects are to provide a downhole drilling assembly having a relatively short overall length and suitable for in line coupling to a drill bit or other well tool such as under reamers.

SUMMARY OF THE INVENTIONS

The present inventions satisfy the aforestated objects by providing a drilling fluid powered rotary drilling motor assembly mounted on the downhole end of a non-rotating fluid conducting drill string having a motor with a plurality of fluid engaging, rotating elements for conversion of the kinetic and pressure energies of the drilling fluid to mechanical power coupled to at least one speed reducing planetary gear stage for rotating a drill bit on the drilling assembly distal end. The drilling assembly may include a lubricator, a drilling fluid filter, a pressure relief valve, a bypass valve and a check valve and is mounted with an output isolation coupling and a bearing package sized to withstand drilling load conditions.

Pressure fluid normally circulated through the drilling system to remove borehole cuttings is supplied to a downhole motor where it acts on a plurality of fluid engaging, rotating elements to produce rotating torque forces. These forces are transmitted to a single or multiple stage planetary gear rotational speed reducing and torque increasing unit that is coupled with the motor output shaft so as to provide the lower rotational speeds needed for drilling. As a result of the high rotational input speeds allowed by the planetary gear reducer, the drilling fluid powered motors are relatively small for the horsepower produced.

The drilling fluid system of the present inventions is conditioned by the provision of a fluid filter to provide the cleanliness of the fluid for sustained motor performance. Certain fluids, such as dry gases, have no lubricating qualities, so a lubricator is provided. Also there is a wide variation of fluid pressure and volume available for power and these must be suitable for motor operation. Therefore, pressure regulator and volume bypass valves are incorporated into the present inventions.

Other important features of the present inventions are an inherently balanced rotor and gearing and an axial motor output that eliminates any need for a universal jointed driveshaft.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only these examples. Various features of the present inventions will be apparent from the drawings and descriptions in which.

DETAILED DESCRIPTION OF THE DRAWINGS

Figure 2:
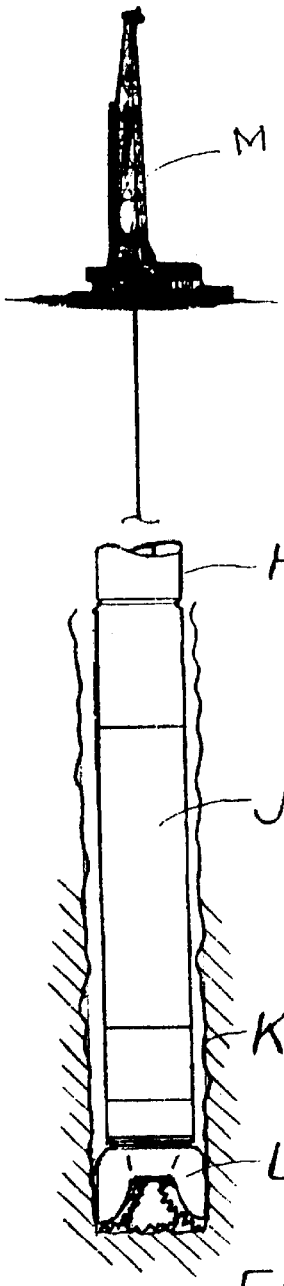
FIG. 2 is a schematic section view illustrating conventional drilling of open hole earth K with a jointed, non-rotating drill string H and a fluid powered rotary drilling assembly J with drill bit L.

The present inventions are described in the following by referring to drawings of examples of how the inventions can be made and used. In these drawings, reference characters are used throughout the views to indicate like or corresponding parts. The embodiments shown and described herein are exemplary. Many details are well known in the art, and as such are neither shown nor described.

Figure 1:
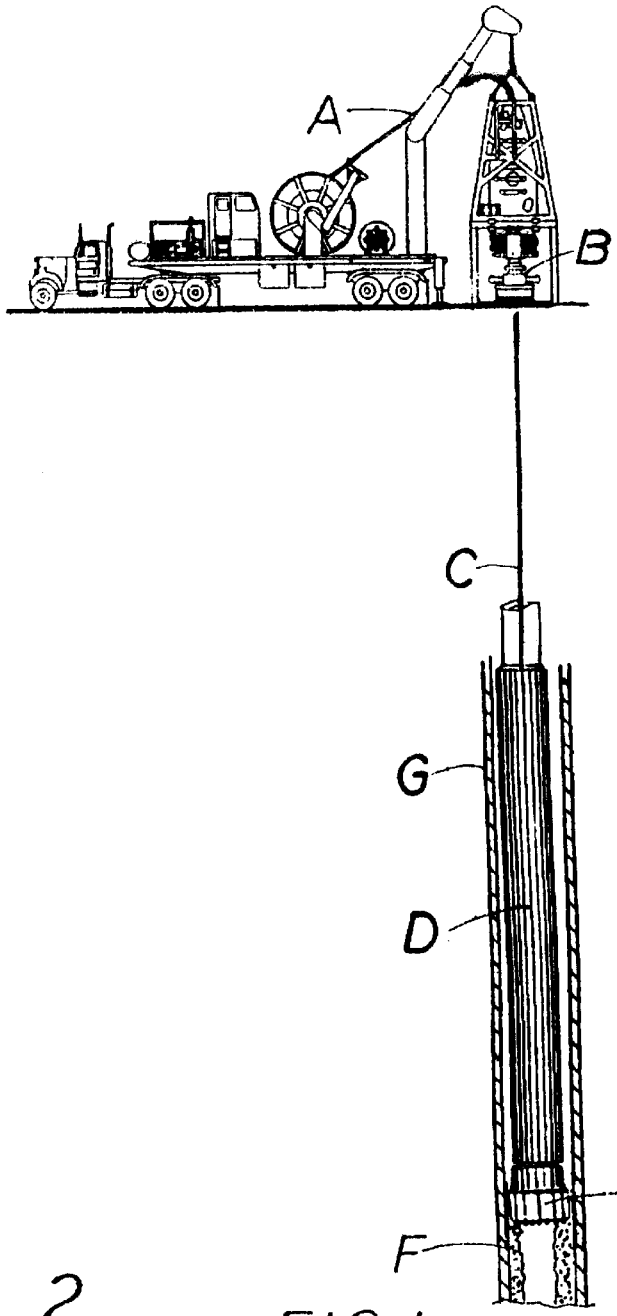
FIG. 1 is a schematic illustration of a mobile coiled tubing oil well workover unit on an old production well showing one application of a fluid driven rotary drilling assembly.

FIG. 1 is a simplified illustration of a mobile coiled tubing unit A as used to workover old production well B, to increase oil production. Because the continuous, comparatively small pressurized tubing C is non-rotatable, drilling fluid powered downhole rotary drilling assembly D, with a drilling bit E, is used. In this manner, barium, paraffin and other minerals F that deposit on well tubing G walls, are loosened and circulated out of the well with the fluid. This modern method of restoring a well to better production replaces the expensive and time consuming older method of using a derrick to pull the jointed production tubing string out of the well for surface cleaning. However, new and better workover tools as represented by the present invention are needed to realize the full potential of this new method under all conditions. FIG. 2 is a schematic section view illustrating conventional drilling of open hole K with a jointed, non-rotating drill string H using a fluid powered rotary drilling assembly J with drilling bit L. Derrick M is necessary in order to add lengths of drill pipe to the drill string H as hole K is deepened.

Figure 3B:
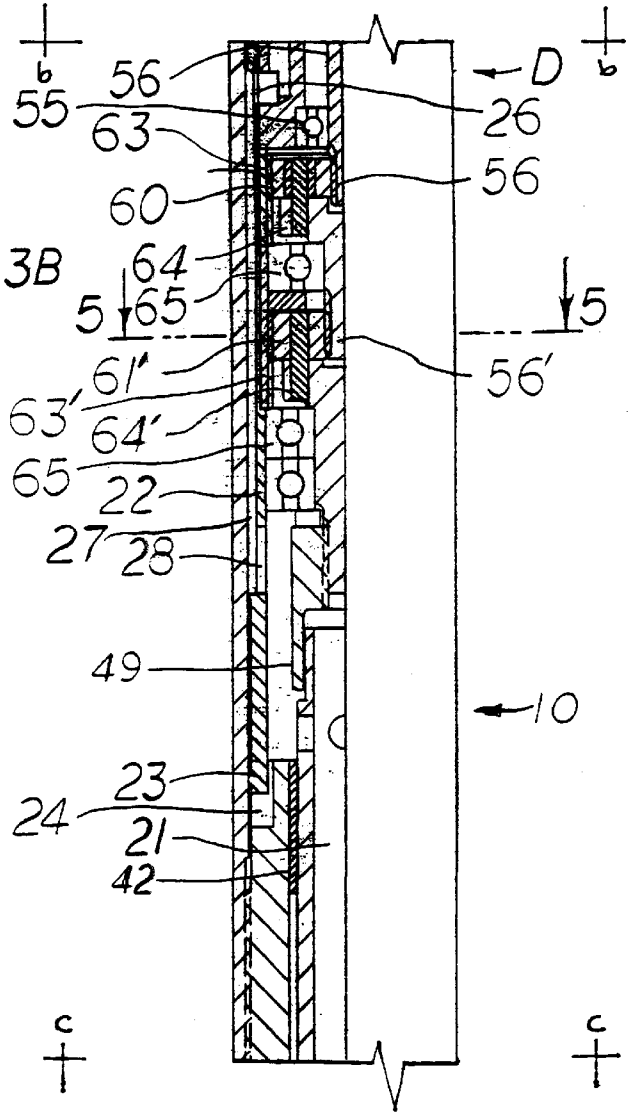
FIGS. 3A–3C are a series of adjacent elevation views in quarter section showing a preferred embodiment of the fluid driven drilling assembly of present inventions.
Figure 3A:
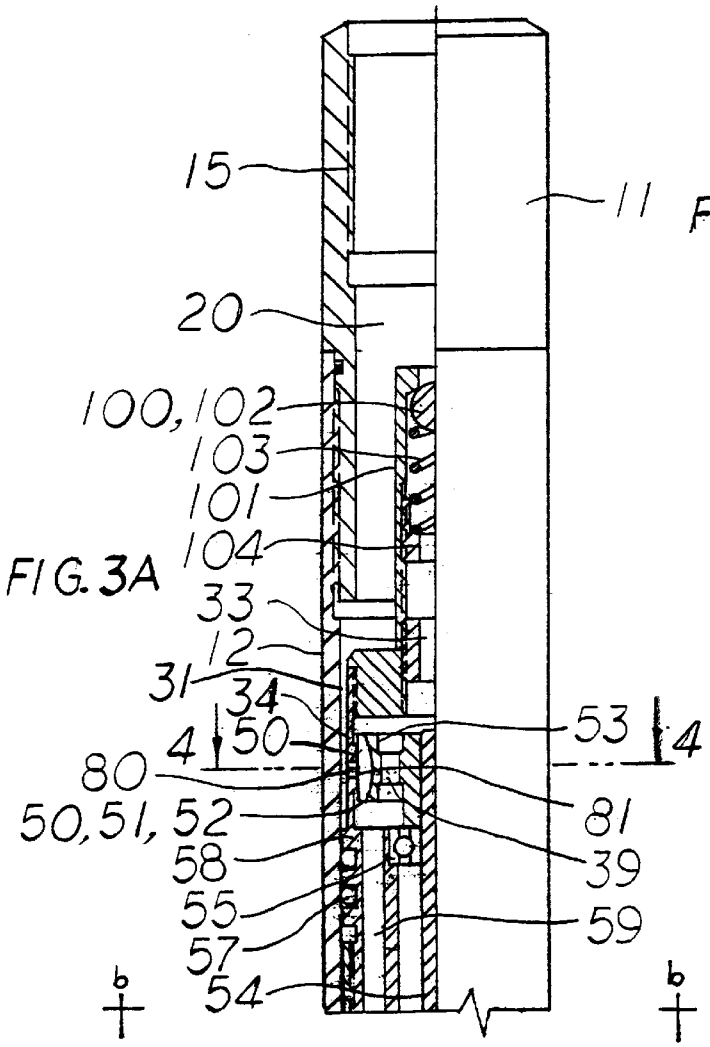
Figure 3C:
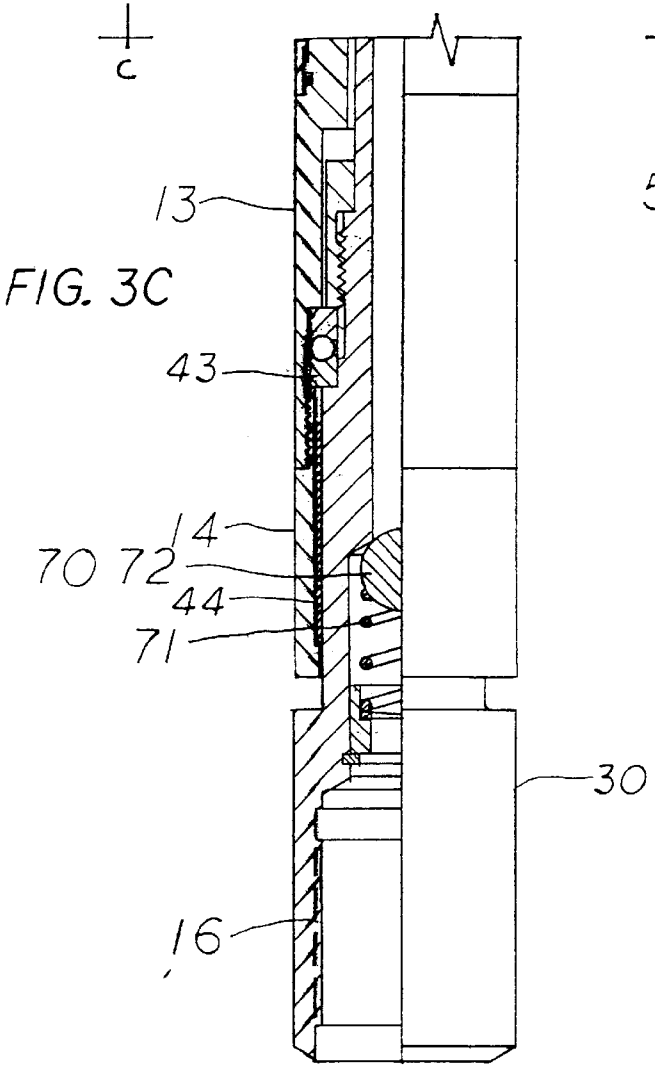
Figure 7B:
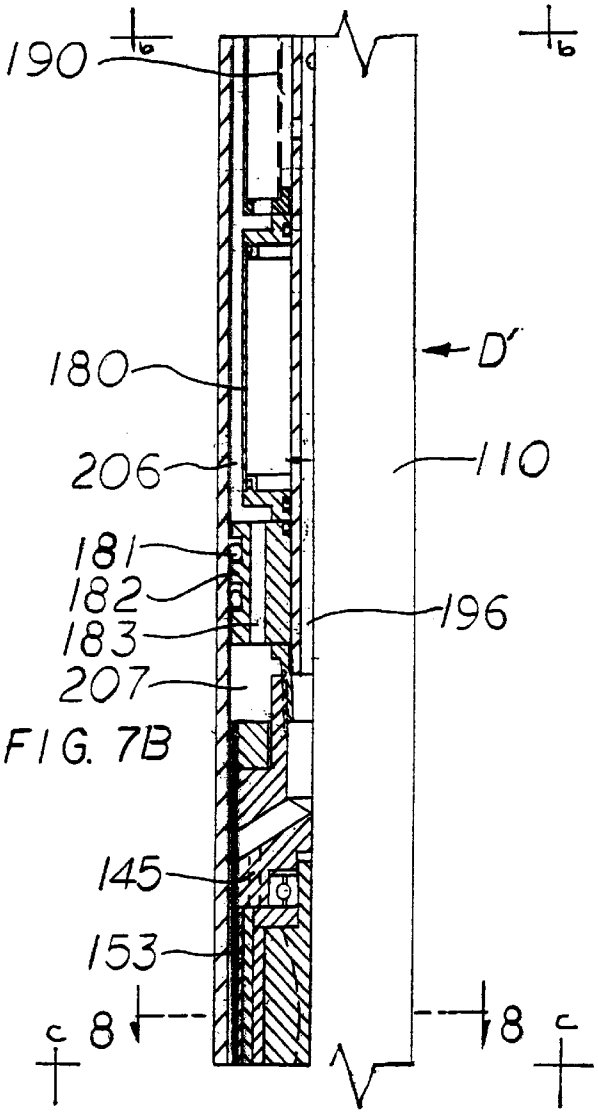
FIGS. 7A–7D are a series of adjacent elevation views in quarter section of a second preferred embodiment of the fluid driven drilling assembly of present inventions.
Figure 7A:
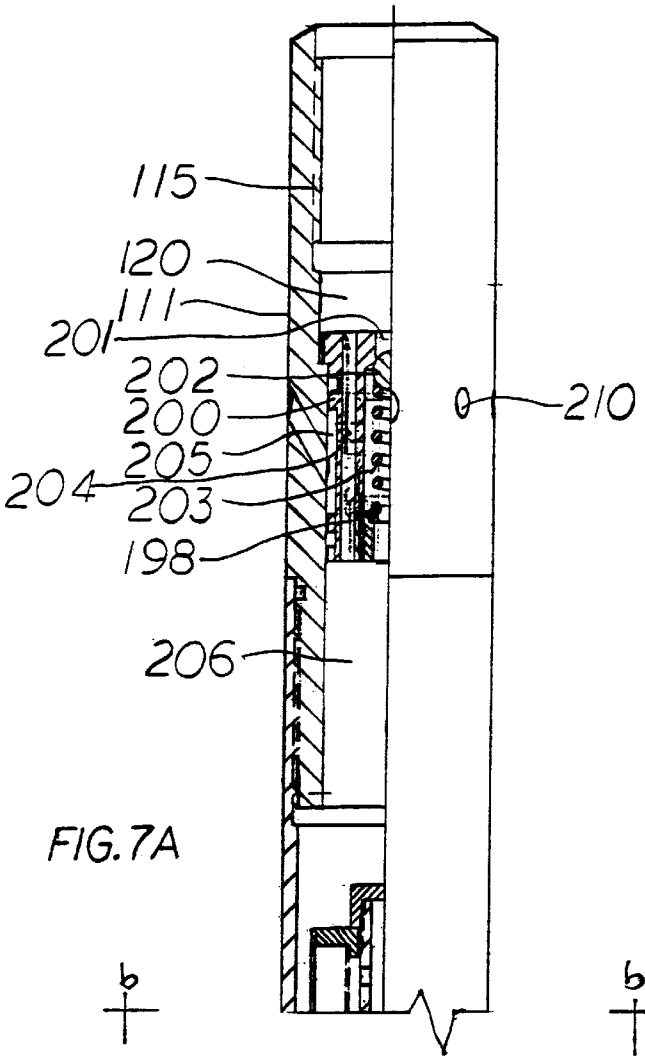
Figure 7D:
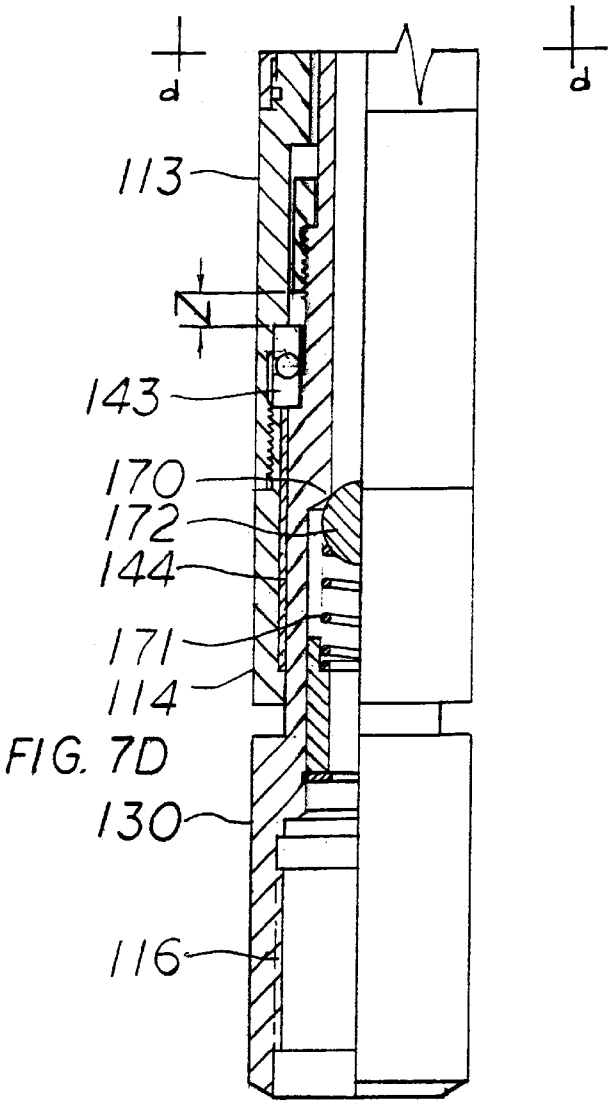
Figure 7C:
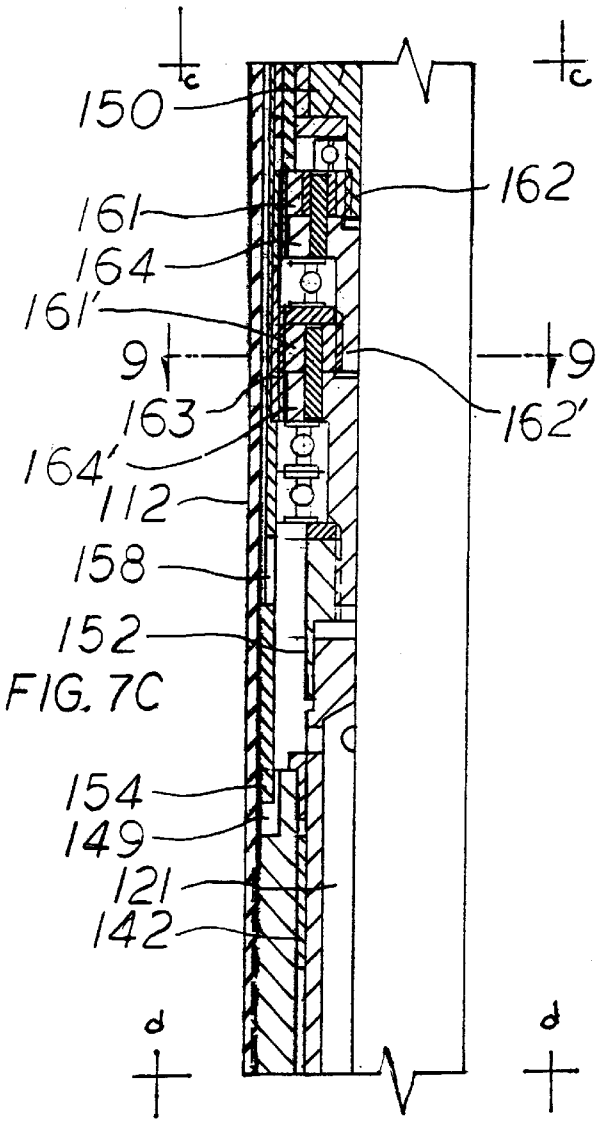

The fluid drilling assembly D, as shown in FIG. 3 comprises: a housing assembly 10 and an output assembly 30 mounted for rotation within housing assembly 10 and extending from the lower end thereof. Housing 10 comprises top sub 11, barrel 12, coupling sub 13 and bearing sub 14, which are all joined by threaded connections to encase motor 50, gear train 60, sleeve 22, support bearings 42, 43, & 44 and the upper end of output assembly 30. The upper end of top sub 11 is adapted for connection to the drill string C or H with threaded tool joint 15 and receives drilling fluid under high pressure from the drill string through flow area 20 of top sub 11 and housing 10. At its lower end, drilling assembly D has a low pressure passageway 21 through which fluid flows in output assembly 30, where drilling bit E is connected at tool joint 16. Drilling fluid is admitted into prime mover 50 through inlet passage 31 and, after passing through and powering prime mover 50, flows through low pressure annulus 27 and ports 28 into interior passageway 21 of rotating output assembly 30. Check valve 70, which has check ball 72 and biasing spring 71, is built into the lower end of passageway 21 to prevent debris from entering drilling assembly D should drilling bit E penetrate a high pressure zone.

Turbine body 58 carries seals 57 and supports bearings 55 for shaft 54 and turbine rotor 51. Turbine body 58 also forms a mounting for stator 34 and has a threaded connection with sleeve 22 in which one or more planetary gear stages 60 are located. Seals 57, mounted in turbine body 58, are in sealing contact with barrel 12 of housing assembly 10. Fluid passageways 59 extend through turbine body 58 to connect with low pressure annulus 27. Radial and thrust bearings 42, 43 and 44 are interposed between output assembly 30 and housing assembly 10 to facilitate the rotation of output assembly 30. Prime mover 50, operated by the through flow of drilling fluid under pressure acting on fluid engaging, rotating elements 52, rotates at a relatively high speed. Planetary speed reduction gear assembly 60, comprising planet gears 61 & 61', planet gear carriers 64 & 64' and fixed internal tooth ring gears 63, is mounted in bearings 65 for rotation and coupled with the output speed of prime mover 50 by motor shaft 54 and sun gear 56. A reduction ratio of at 20:1 or greater, depending on bore hole diameter, is required to provide rotational speed and torque suitable for drilling. The greatly reduced output speed of planetary gear assembly 60 is transmitted from the downstream planet gear carrier 64' to output assembly 30 by coupling 49. Coupling 49 preferably has an internal hexagonal shape compatible with a hexagon shaped upper end of shaft 30 for transfer of torque but a has fairly loose slip fit, so that slight longitudinal movements of output shaft 30 are isolated from the planetary gear train 60 and motor 50. Rotor 51 of prime mover 50 is relatively small, rotates at high speed and produces a relatively low output torque. Planetary gear assembly 60 reduces the output speed appropriately and multiplies this torque to a value suitable for drilling.

Overpressure relief valve 100 is made in modular form so that it can be installed or removed as a unit. Valve 100, comprising valve body 101, ball 102, spring 103 and adjustment screw 104, is threaded onto the upper end of stator 34. Overpressure relief valve 100 bypasses fluid to reduce fluid pressure and volume to prime mover 50. Whenever the differential pressure across prime mover 50 exceeds a predetermined value, fluid is allowed to pass from the upper, high pressure end of prime mover 50 to the lower end through passageways 33 and 39. Thus, stator 34 and jet orifices 80 divide the inlet, high pressure end of rotary drilling assembly D from the discharge, low pressure end. Drilling fluid flows through orifices 80 as high velocity jets, which impinges on buckets 81 to rotate turbine wheel 53. After passing across buckets 81, the fluid enters the low pressure side of the system and continues through turbine body passageway 59 and upper ports 26 in sleeve 22 to pass down through annulus 27, through lower ports 28 and into the upper central passageway 21 of output shaft 30 and on through check valve 70 into and through the attached, but unshown, drilling bit E. After exiting the drilling bit, the fluid serves to carry borehole cuttings up the well annulus around drill string to the surface. Prime mover 50 and planetary gear assemblies 60 may be assembled with sleeve 22 as a unit to allow installation and removal from drilling assembly D as a module. Lugs 23 on lower end of sleeve 22 are meshed with recesses 24 in the upper portion of coupling sub 13 to prevent sleeve rotation relative to coupling sub 13. Sleeve 22 transfers the reverse reaction torque from prime mover 50 to coupling sub 13.

Figure 6:
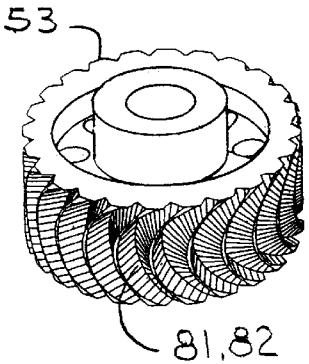
FIG. 6 is a perspective view of the turbine wheel rotor of FIG. 3.
Figure 4:
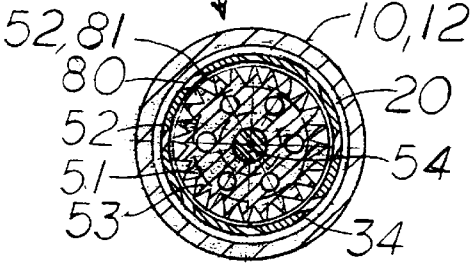
FIG. 4 is a cross-section view of the fluid driven rotary drilling assembly of FIG. 3, taken along lines 4—4.

As shown in FIGS. 3, 4 and 6, the fluid engaging elements 52 of prime mover 50 take the form of turbine wheel buckets 81 in this preferred embodiment. The pressure fluid normally circulated through the drilling system enters prime mover 50 through top sub 11 and enters passageway 20 of housing 10 between barrel 12 and stator 34 and goes through jet orifices 80 at a relatively high velocity to impinge substantially tangent to the turbine wheel buckets 81 of turbine wheel 53, causing it to rotate. The differential pressure across prime mover 50, less the temperature increase of the fluid due to turbulence and fluid friction losses, equates to the power generated by turbine wheel 53. Turbine wheel 53 is mounted on shaft 54 with buckets 81 in close proximity to orifices 80. Rotor assembly 51 includes turbine wheel 53 and motor shaft 54. Motor shaft 54 is mounted to rotate in bearings 55 and has sun gear 56 at its lower end to transmit torque from turbine wheel 53 to gear train 60 (ref. FIG. 3).

Figure 5:
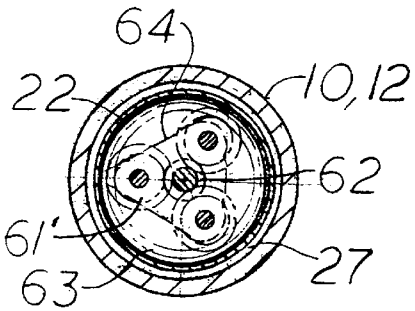
FIG. 5 is a horizontal section view showing the planetary gear speed reduction assembly of FIG. 3 taken along lines 5—5.

FIG. 5 shows a cross-section of the second stage of planetary gear assembly 60, which may have one, two or more such stages. External tooth planet gears 61' are mounted on planetary gear carriers 64' and are engaged by sun drive gear 56' and inside a co-axial fixed internal tooth ring gear 63'. Ring gear 63' is mounted in sleeve 22 and annulus 27 is seen between sleeve 22 and barrel 12 of housing 10. Suitable ball, sleeve or roller bearings 65 are provided on shafts and rotating gears to reduce power losses and increase mechanism life while reducing speed and increasing torque proportionally. Rotating speed reduction ratios in simple epicyclic trains may be expressed as 1+R/S to 1 where R represents the pitch diameter of the fixed ring gear and S represents the pitch diameter of the sun gear. In compound or coupled epicyclic gear trains the speed reduction and torque increase becomes 1+(PS/PR)(R/S) to 1 which can be considerable in a small package. Now although specific epicyclic gear trains are described, a number of variations are possible in practical applications.

FIG. 6 shows the preferred configuration of turbine wheel buckets 81 for receiving the fluid stream from stator orifices 80 whereby its direction is turned back approximately 165 degrees from its initial direction. Also, stator 34 is undercut or recessed on each side of the orifices 80 to reduce fluid drag and promote discharge of the spent fluid from turbine wheel buckets 81 for the most effective energy transfer. The cupped shape of buckets 81, and the radial serrations 82 that characterize both the leading convex and trailing concave surfaces of buckets 81, combine synergistically to convert virtually all of the kinetic energy of the drilling fluid into rotor speed and torque. Absent serrations 82, the efficiency of this conversion is diminished significantly. Turbine efficiency is largely determined by the shape and surface characteristics of turbine wheel surface 81 and although the present inventions incorporates a preferred turbine wheel embodiment, the inventions are not limited to this embodiment.

Figure 9:
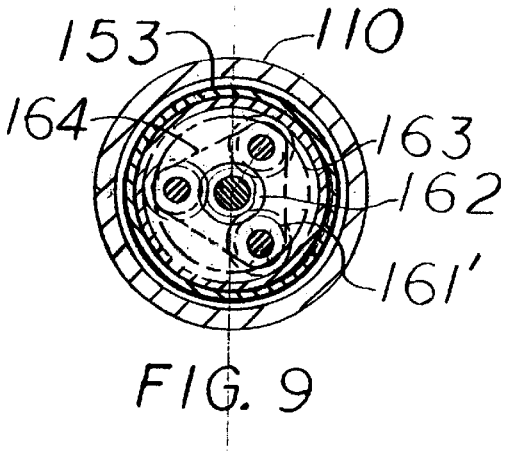
FIG. 9 is a horizontal section view showing the planetary gear speed reduction assembly of FIG. 7 taken along lines 9—9.
Figure 8:
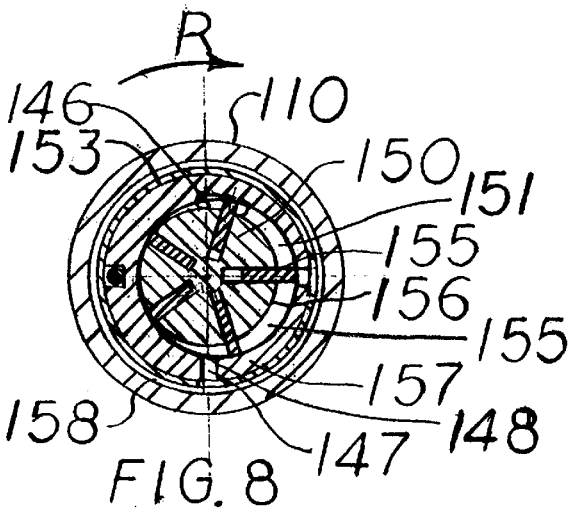
FIG. 8 is a horizontal cross-sectional view of the second preferred embodiment of the fluid driven rotary drilling motor of the present invention taken along lines 8—8 of FIG. 7.

FIGS. 7, 8 and 9 show how fluid drilling assembly D' comprises a housing assembly 110, with output assembly 130 mounted to rotate within the housing assembly 110 and extend from its lower end. Drilling fluid is received into rotary drilling assembly D' at high pressure flow area 120, from which it flows through passages 198 into flow areas 206. Flow restricting element 182 is sealed with respect to barrel 112 of housing 110, and includes a flow restricting orifice, which creates back pressure to force fluid to flow through filter 190 and lubricator 180 into central passageway 196 before entering prime mover 150 through inlet port 145. Fluid is discharged from prime mover 150 through discharge port 147 into low pressure annulus 158. Fluid that passes through orifice 183 passes into cavity 207 and thence into low pressure annulus 158. Low pressure annulus 158 communicates with low pressure passageway 121, through which fluid flows to the lower end of output assembly 130, where drilling bit E' is connected at tool joint 116. The differential pressure across prime mover 150, less the temperature increase of the fluid due to turbulence and fluid friction losses, equates to the power generated by prime mover 150.

Fluid powered rotary drilling assembly D' may incorporate a fluid pressure relief valve 200 for overpressure protection, to reduce both fluid pressure and volume to prime mover 150. This relief valve 200 is located in top sub 111 of housing 110 and diverts excess fluid to the outside of housing 110. If the pressure in chamber 120 exceeds a preset value, ball 202 of valve 200 is forced to depress spring 203 proportionally so as to vent the fluid excess through check valve cavity 201 and radial passages 204 into annulus 205, from whence it is dumped through external ports 210 into the well bore annulus. Thus, increasing drill string fluid volume also increases pressure and vents the excess into the well bore annulus so as to increase annulus fluid velocity and enhance drill bit cuttings removal. Lubricator 180 may be included to supply small amounts of oil along with the fluid entering prime mover 150 for reduced friction operation and longer component life. Fluid filter 190 may be included to remove any coarse inclusions from the fluid entering prime mover 150 and check valve 170 may be mounted in output shaft 130, to prevent debris from entering housing 110 when drilling into a high pressure zone. Relief valve 200, lubricator 180 and filter 190 are installed in drilling assembly D' as modules.

Housing 110 comprises top sub 111, barrel 112, coupling sub 113 and bearing sub 114, which are all joined by threaded connections to encase prime mover 150, gear train 160, sleeve 153, support bearings 142, 143, & 144 and the upper end of output assembly 130. The upper end of top sub 111 is adapted for connection to drill string C or H with threaded tool joint 115 and receives drilling fluid under high pressure from the drill string through flow area 120 of top sub 111 and housing 110. Support bearings 142, 143, & 144 allow output shaft 130 to rotate under drilling load conditions. Rotation of output shaft 130 for drilling is powered by prime mover 150, wherein the fluid engaging elements are rotary vanes 155, driven to rotate by fluid pressure. Planetary speed reducer 160 comprises one or more planetary gear stages One or more planetary gear rotary speed reduction units 160, with corresponding torque increasing gear train coupled with prime mover 150 on the upper end and the motor output shaft 130 on the other end of the gear train 160 for power transmission through coupling 152 from prime mover 150 to motor output shaft 130. Check valve 170 mounted in the output shaft 130 includes a spring 171 and spring biased ball 172 to prevent debris from entering housing 110. Prime mover 150 is relatively small and rotates at very high speed and produces nominal torque which passes through the planetary gear assemblies 160 which multiplies the available torque while simultaneously reduces the rotary speed to make the torque and rotary speed suitable for drilling.

Prime mover 150 and planetary gear train 160 may be assembled together with sleeve 153 for installation and removal in modular form from the drill assembly D'. Lugs 154 on lower end of sleeve 153 are meshed with recesses 149 in the upper portion of coupling 113 for preventing sleeve rotation relative to coupling 113. Torque coupling 152 has a hexagonal socket end, compatible with hexagon shaped upper end of shaft 130 for transfer of torque, but has fairly loose slip fit so that slight longitudinal movements of shaft 130 are isolated from the planetary gear train 160 and prime mover 150.

Figure 10:
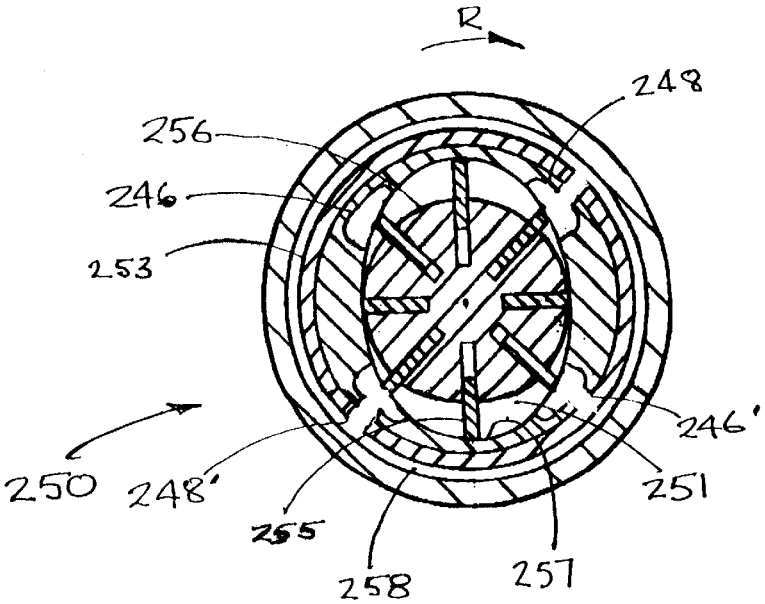
FIG. 10 is a cross-sectional view of an alternative, pressure balanced version of the drilling motor of FIG. 8.

FIGS. 7 and 8 show a pressure unbalanced configuration of prime mover 150, but the present inventions also include a balanced configuration as shown in FIG. 10. Prime mover 150 has longitudinal vanes 155, slideably fitting into radial slots circumferentially spaced about the periphery of rotor 156. Rotor 156 is mounted in eccentric, essentially cylindrical cam ring 157 and cam ring 157 is fitted inside of sleeve 153. Vanes 155 follow the eccentric inner surface of cam ring 157 as they rotate in direction R, and fluid passes into the variable volume chambers 151 created between vanes 155 and cam ring 157 as prime mover 150 rotates. The output torque of vane type prime mover 150 is developed from the pressure imbalance acting on vanes 155. The effective torque at motor output shaft 159 is proportional to the product of exposed vane area, multiplied by the pressure differential across the pressurized vanes 155 and the effective moment arm of the exposed vane area. Fluid is introduced at pressure port 146, into an expanding rotor volume and is discharged from a decreasing rotor volume at opposed discharge port 148. The fluid flows through discharge ports 148, and a matching hole in sleeve 153. The fluid then passes down, through low pressure annulus 158, between housing 110 and sleeve 153 and passes through ports 158 in sleeve 153 and into the upper central passageway 121 of output shaft 130. The fluid then passes through check valve 170, into and through the attached bit where the fluid velocity transports borehole cuttings up the well annulus to the surface.

As shown in FIGS. 7 and 9, planetary gear train 160 consists of one or more epicyclic gear stages, basically the same as planetary gear train 60 of FIGS. 3 and 5. External tooth planet gears 161 and 161' are mounted on planetary gear carriers 164 and 164' respectively. Planet gears 161 and 161' mesh with external tooth sun gear 162 or 162' and fixed internal tooth ring gear 163. Suitable ball, sleeve or roller bearings are provided on shafts and rotating gears to reduce power losses and increase mechanism life. Although specific epicyclic gear trains are described, a number of variations are possible in practical applications in order to reduce speed and increase output torque appropriately.

FIG. 10 shows a pressure balanced prime mover 250 as an alternative to unbalanced prime mover 150. Prime mover 250 has longitudinal vanes 255, slideably fitting into radial slots of rotor 256. Rotor 256 is mounted in cam ring 257 and sleeve 253. Fluid passes into the variable volume chambers 251 created by vanes 255 and cam ring 257 of vane type prime mover 250 rotating in direction R. Output torque is developed from the pressure imbalance acting on vanes 255. The effective output torque developed by prime mover 250 is proportional to the product of exposed vane area, multiplied by the pressure differential across the two pressurized vanes 255 and the effective moment arm of the exposed vane area. Vanes 255 follow the elliptically contoured inner surface of cam ring 257 so that there are two torque producing cycles per vane during each revolution of prime mover 250. Fluid is introduced through inlet ports 246 and 246', separated by 180 degrees, so as to provide opposed pressure forces on rotor 256. The fluid is discharged at opposed discharge ports 248 and 248', each located 90 degrees of rotation after the respective inlet ports.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. In drilling fluid powered rotary drilling apparatus mounted on the downhole end of a non-rotating fluid conducting drill string and having a fluid powered, axially oriented rotor and a rotary drill bit, the improvement comprising:

a pressure relief and bypass valve mounted to receive the drilling fluids from the fluid conducting drill string and reduce the drilling fluid volume and pressure, when the fluid pressure exceeds a predetermined value;

a plurality of fluid engaging turbine wheel buckets mounted on the rotor to drive the rotation thereof;

at least one speed reducing planetary gear stage axially coupled to the rotor, so as to reduce the rotational speed and increase the torque output thereof for drilling; and a rotatable output shaft with upper and lower ends and having a fluid passageway from the upper end to the lower end, the upper end being connected to receive the planetary gear torque output.

2. The improvement of claim 1 and further comprising a drilling fluid filter mounted to remove coarse inclusions from the drilling fluid before contact with the turbine wheel buckets.

3. The improvement of claim 1 and further comprising a drilling fluid check valve, mounted in the output shaft passageway so as to prevent back-flow of well pressured fluid from entering into the drilling apparatus.

4. In drilling fluid powered rotary drilling apparatus mounted on the downhole end of a non-rotating fluid conducting drill string and having a fluid powered, axially oriented rotor and a rotary drill bit, the improvement comprising:

a pressure relief and bypass valve mounted to receive the drilling fluids from the fluid conducting drill string and reduce the drilling fluid volume and pressure, when the fluid pressure exceeds a predetermined value;

a plurality of fluid engaging fluid motor vanes, slideably mounted on the rotor to drive the rotation thereof;

at least one speed reducing planetary gear stage axially coupled to the rotor, so as to reduce the rotational speed and increase the torque output thereof for drilling;

a rotatable output shaft with upper and lower ends and having a fluid passageway from the upper end to the lower end, the upper end being connected to receive the planetary gear torque output; and a drilling fluid check valve mounted in the output shaft passageway so as to prevent back-flow of well pressured fluid.

5. The apparatus of claim 4 and further comprising a drilling fluid lubricator, mounted to supply lubricant to the drilling fluid before contact with the fluid motor vanes.

6. Fluid powered drilling apparatus, for axial mounting on a non-rotating, pressurized drilling fluid conducting drill string and driving a rotary drill bit comprising:

a motor having an axially oriented rotor;

a plurality of turbine wheel buckets mounted on the rotor to drive the rotation thereof through engagement with pressurized drilling fluid;

a pressure relief and bypass valve mounted to receive the pressurized drilling fluid and limit the pressure thereof to a predetermined value prior to admission of the fluid to the fluid to the turbine wheel buckets;

a rotatable output shaft with upper and tower ends and having a fluid passageway from the upper end to the lower end, the lower end being configured for connection to a rotary drill bit; and at least one speed reducing planetary gear stage axially coupled to the rotor and to the output shaft upper end, so as to reduce the rotational speed of the output shaft and increase the torque capability thereof for drilling.

7. The apparatus of claim 6 and further comprising a drilling fluid filter mounted to remove coarse inclusions from the drilling fluid before contact with the fluid engaging elements.

8. The apparatus of claim 6 and further comprising a drilling fluid check valve, mounted in the output shaft passageway so as to prevent back-flow of well pressured fluid from entering into the drilling apparatus.

9. Fluid powered drilling apparatus, for axial mounting on a non-rotating fluid conducting drill string and driving a rotary drill bit comprising:

a motor having an axially oriented rotor;

a plurality of fluid motor vanes, slideably mounted on the rotor to drive the rotation thereof through engagement with pressurized drilling fluid;

a pressure relief and bypass valve mounted to receive the pressurized drilling fluid and limit the pressure thereof to a predetermined value prior to admission of the fluid to the fluid motor vanes;

a rotatable output shaft with upper and lower ends and having a fluid passageway from the upper end to the lower end, the lower end being configured for connection to a rotary drill bit;

at least one speed reducing planetary gear stage axially coupled to the rotor and to the output shaft upper end, so as to reduce the rotational speed of the output shaft and increase the torque capability thereof for drilling; and a drilling fluid check valve, mounted in the output shaft passageway, so as to prevent back-flow of well pressured fluid from entering into the drilling apparatus.

10. Fluid powered drilling apparatus, for axial mounting on a non-rotating fluid conducting drill string and driving a rotary drill bit comprising:

a motor having an axially oriented rotor;

a plurality of fluid motor vanes, slideably mounted on the rotor to drive the rotation thereof through engagement with pressurized drilling fluid;

a pressure relief and bypass valve mounted to receive the pressurized drilling fluid and limit the pressure thereof to a predetermined value prior to admission of the fluid to the fluid motor vanes;

a rotatable output shaft with upper and lower ends and having a fluid passageway from the upper end to the lower end, the lower end being configured for connection to a rotary drill bit;

at least one speed reducing planetary gear stage axially coupled to the rotor and to the output shaft upper end, so as to reduce the rotational speed of the output shaft and increase the torque capability thereof for drilling; and a drilling fluid lubricator, mounted to supply lubricant to the drilling fluid before contact with the fluid motor vanes.

11. A drilling fluid powered rotary drilling motor assembly for axial mounting on the downhole end of a non-rotating, fluid conducting drill string and driving a rotary drill bit comprising:

a housing configured for attachment to the downhole end of a non-rotating, fluid conducting drill string;

a prime mover axially mounted in the housing and having a rotor with a plurality of fluid engaging elements to drive the rotor output rotation, wherein;

the fluid engaging elements are a plurality of vanes, slideably mounted in circumferentially spaced slots on the rotor periphery;

a stator has an internal cam for maintaining contact with the vane outer edge so that there is a significant change in the volume contained between two adjacent vanes at least once during every revolution of the rotor;

at least one inlet port is provided to admit drilling fluid to the changing volume contained between two adjacent vanes as the volume is increasing;

at least one outlet port is provided to exhaust drilling fluid from the changing volume contained between two adjacent vanes as the volume is decreasing, so that the internal cam of the stator cooperates with the vaned rotor to produce rotation thereof;

a gear train mounted in the housing and coupled to the output rotation of the prime mover, the gear train having at least one speed reducing, torque increasing gear stage and an axially rotating output; and a rotatable output shaft with upper and lower ends, having a fluid passageway from the upper end to the lower end, connected at the upper end to the axial output of the at least one gear stage and the lower end being configured for connection to a rotary drill bit.

12. A drilling fluid powered rotary drilling motor assembly according to claim 11 and further comprising a pressure relief and bypass valve mounted to receive the pressurized drilling fluid and limit the pressure thereof to a predetermined value prior to admission of the fluid to the fluid engaging elements and exhaust excess fluid through the housing to the well annulus, so as not to contact the fluid engaging elements.

13. A drilling fluid powered rotary drilling motor assembly according to claim 11 and further comprising a drilling fluid filter mounted to remove coarse inclusions from drilling fluid before contact with the fluid engaging elements.

14. A drilling fluid powered rotary drilling motor assembly according to claim 11 and further comprising a drilling fluid check valve, mounted in the output shaft passageway so as to prevent back-flow of well pressured fluid from entering into the drilling apparatus.

15. A drilling fluid powered rotary drilling motor assembly according to claim 11 and further comprising a drilling fluid lubricator, mounted to supply lubricant to the drilling fluid before contact with the fluid engaging elements.

16. A drilling fluid powered rotary drilling motor assembly according to claim 11 and further comprising:

a passageway for relatively high pressure drilling fluid through the prime mover and connecting with the passageway in the output shaft; and a passageway for relatively low pressure drilling fluid in parallel with the passageway for relatively high pressure drilling fluid and connecting with the output shaft passageway.

17. A drilling fluid powered rotary drilling motor assembly according to claim 11 wherein the fluid passageway from the upper end to the lower end is connected to receive drilling fluid discharged from the prime mover.

18. A drilling fluid powered rotary drilling motor assembly for axial mounting on the downhole end of a non-rotating, fluid conducting drill string and driving a rotary drill bit comprising:

a housing configured for attachment to the downhole end of a non-rotating, fluid conducting drill string;

a prime mover axially mounted in the housing and having a rotor with a plurality of fluid engaging elements to drive the rotor output rotation, wherein;

the fluid engaging elements are buckets, peripherally mounted on the rotor so as to provide a turbine wheel;

a circular stator mounted around the turbine wheel has a series of drilling fluid jets directed in a substantially tangential direction with respect to the fluid engaging buckets so that the stator cooperates with the turbine wheel to produce rotation thereof;

a first fluid passageway from the fluid conducting drill string to the drilling fluid jets;

a gear train mounted in the housing and coupled to the output rotation of the prime mover, the gear train having at least one speed reducing, torque increasing gear stage and an axially rotating output;

a rotatable output shaft with upper and lower ends, having an output shaft fluid passageway from the upper end to the lower end, connected at the upper end to the axial output of the at least one gear stage and the lower end being configured for connection to a rotary drill bit; and a second fluid passageway from the turbine wheel to the rotatable output shaft passageway.

19. A drilling fluid powered rotary drilling motor assembly according to claim 18 wherein the drilling fluid jets are substantially parallel with lines tangent to the inside diameter of the stator.

20. A drilling fluid powered rotary drilling motor assembly according to claim 18 wherein the fluid engaging buckets further comprise convex leading surfaces and cupped concave trailing surfaces, with both being radially serrated.

21. A drilling fluid powered rotary drilling motor assembly according to claim 18 and further comprising a pressure relief and bypass valve mounted to receive the pressurized drilling fluid in the first fluid passageway and by-pass excess fluid to the second fluid passageway, so as not to contact the fluid engaging buckets.

22. A drilling fluid powered rotary drilling motor assembly according to claim 18 and further comprising a drilling fluid check valve, mounted in the output shaft passageway, so as to prevent back-flow into the drilling apparatus.

23. A drilling fluid powered rotary drilling motor assembly according to claim 18 and further comprising a third passageway for relatively low pressure drilling fluid in parallel with the first passageway and connecting with the second passageway.

24. A method for powering rotary drilling apparatus mounted on the downhole end of a non-rotating fluid conducting drill string and having an axially oriented rotor and a rotary drill bit comprising the steps of:

mounting a plurality of circumferentially spaced, fluid engaging buckets on the axially oriented rotor;

directing pressurized drilling fluid through at least one orifice and converting the potential energy of the pressurized fluid to kinetic energy of a fluid stream;

directing the fluid stream from the at least one orifice to impinge tangentially on the rotating buckets so that the direction of the fluid stream is turned back by approximately 165 degrees from its tangential path, thereby substantially converting its kinetic energy into rotor rotational speed and torque;

reducing the rotational speed of the rotor so as to drive the rotary drilling bit with proportionately increased torque force; and by-passing drilling fluid so that a portion thereof is not directed to the fluid engaging buckets when the drilling fluid pressure exceeds a predetermined value.

* * * * *